US006484125B1

(12) United States Patent
Huang et al.

(10) Patent No.: US 6,484,125 B1
(45) Date of Patent: Nov. 19, 2002

(54) SERVICE INFORMATION DERIVED FROM ELEVATOR OPERATIONAL PARAMETERS

(75) Inventors: Harry Z. Huang, Plainville, CT (US); Juan A. Lence Barreiro, Santiago de Compostela (ES); Chouhwan Moon, Glastonbury, CT (US); Ronald R. Pepin, Windsor Locks, CT (US); Gary L. Freeland, Plainville, CT (US); Robert H. Mashiak, Somers, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/567,837

(22) Filed: May 9, 2000

(51) Int. Cl.[7] ..... G06E 11/30
(52) U.S. Cl. ..... 702/183; 187/393
(58) Field of Search ..... 702/183; 187/393

(56) References Cited

U.S. PATENT DOCUMENTS

| | | | | |
|---|---|---|---|---|
| 4,418,795 A | * | 12/1983 | Trosky et al. | 187/391 |
| 4,512,442 A | * | 4/1985 | Moore et al. | 187/393 |
| 4,750,591 A | * | 6/1988 | Coste et al. | 187/247 |
| 4,898,263 A | * | 2/1990 | Manske et al. | 187/247 |
| 5,210,704 A | * | 5/1993 | Husseiny | 702/34 |
| 5,760,350 A | * | 6/1998 | Pepin et al. | 187/316 |
| 5,787,020 A | * | 7/1998 | Molliere et al. | 187/393 |

FOREIGN PATENT DOCUMENTS

JP 08225266 * 9/1996

OTHER PUBLICATIONS

Stark, Henry. Probability, Random Processes, and Estimation Theory for Engineers. pp. 18–19. Prentice–Hall, 1986.*

* cited by examiner

*Primary Examiner*—John S. Hilten
*Assistant Examiner*—Jacquelyn M. Myster

(57) ABSTRACT

The mean number of elevator door reversals, $\mu$, in groups of related door reversals, and the standard deviation, $\sigma$, from the mean, are used to determine the likelihood that door reversals are caused by passenger interference; the likelihood is low if a recent number of reversals exceeds $\mu+3\sigma$, , is medium if two out of three recent reversals exceed $\mu+2\sigma$, and otherwise is high. The floors at which related notable elevator features occur are compared to determine a floor factor, F, depending on whether the notable feature occurs only at one floor or at more than one floor. Estimated probabilities, P'(S/C), that any component, C, will result in a symptom, S, (where S=first and second notable features in a related group and the accompanying floor factor, F) are provided by experts; the probability of P'(C) of any failure being of any given component is determined from failure history; and an estimated probability, P'(C/S), that symptom S is caused by component C is given by:

$$\frac{P'(S/C)\ P(C)}{\sum_c P'(S/C)\ P(C)}.$$

15 Claims, 9 Drawing Sheets

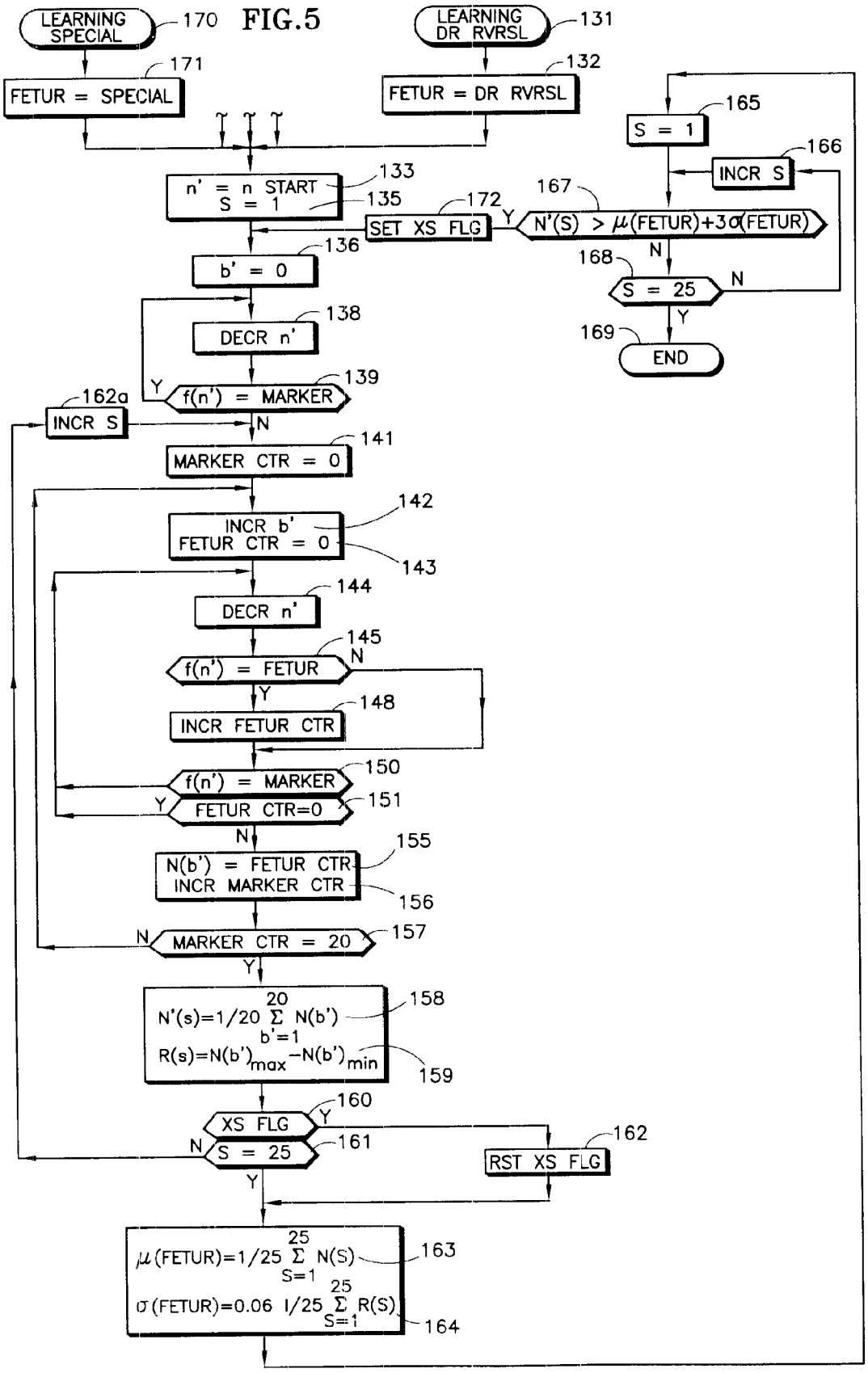
FIG.5
LEARNING SPECIAL
170
FETUR = SPECIAL
171
LEARNING DR RVRSL
131
FETUR = DR RVRSL
132
n' = n START
S = 1
133
135
SET XS FLG
172
b' = 0
136
DECR n'
138
f(n') = MARKER
139
162a
INCR S
MARKER CTR = 0
141
INCR b'
FETUR CTR = 0
142
143
DECR n'
144
f(n') = FETUR
145
INCR FETUR CTR
148
f(n') = MARKER
150
FETUR CTR=0
151
N(b') = FETUR CTR
INCR MARKER CTR
155
156
MARKER CTR = 20
157
N'(s)=1/20 Σ N(b')
b'=1
20
R(s)=N(b')max−N(b')min
158
159
XS FLG
160
S = 25
161
RST XS FLG
162
μ(FETUR)=1/25 Σ N(S)
S=1
25
σ(FETUR)=0.06 1/25 Σ R(S)
S=1
25
163
164
S = 1
165
INCR S
166
167
N'(S) > μ(FETUR)+3σ(FETUR)
168
S = 25
169
END
Y
N

SERVICE INFORMATION DERIVED FROM ELEVATOR OPERATIONAL PARAMETERS

RELATED APPLICATIONS

Related subject matter is disclosed in U.S. patent application Ser. No. 09/567,845 now U.S. Pat. No. 6,330,936, filed contemporaneously herewith.

TECHNICAL FIELD

This invention relates to monitoring elevator operation, and providing information useful in servicing, in response to operational parameters of the elevator.

BACKGROUND ART

The monitoring of elevator operation for maintenance and repair purposes has long been known. Typically, counters may record the number of runs, the number of times a door opens or closes, loss of safeties, and the like. In some cases, the data is reduced by statistical means, such as providing the mean time to open a door or other event, coupled with a normal variance thereof. Frequently, this approach will mask data that is significant in maintaining and servicing elevators; the data is difficult to understand and apply to elevator servicing; and it has been found to be of little value in resolving elevator problems during repair. The use of present-day elevator monitoring systems has been shown to result in many unnecessary service calls, and when the service personnel arrives at the elevator, the information does not significantly help in pointing to the problem. All of these problems are further compounded when the elevator is operating normally at the time that the service personnel arrives.

DISCLOSURE OF INVENTION

Objects of the invention include provision of improved analysis of elevator operating data to trigger service calls; providing elevator operation messages that more closely relate to real elevator problems; minimizing data storage requirements in elevator monitoring; providing elevator maintenance information which is simple to understand and can be managed easily by service personnel; providing elevator information which can be managed easily by service personnel without the help of an analysis tool, such as a microcomputer; providing improvements in information which may be used for routine maintenance as well as for servicing failures.

According to the present invention, operational parameters of an elevator, including conditions and events, are monitored and used to develop the likelihood that an event is caused by passenger interference, rather than by component failure. According further to the invention, similar notable events are analyzed to determine if they occurred on the same floor or on different floors, and to provide a related floor factor. In accordance with the invention, the occurrence of a notable event is processed with prior notable events to generate symptoms including the first and second features of a group of related features and the related floor factor. In accordance further with the invention, the probability that failure of a particular component is the cause of an indicated symptom is estimated from expert opinion and probability of such component failing. Further, the invention combines the three aforementioned functions, which may be incorporated within a system utilizing the invention set forth in the aforementioned copending patent application.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 5 is a high level logic flow diagram of a learning process routine.

BEST MODE FOR CARRYING OUT THE INVENTION

Figure 1:
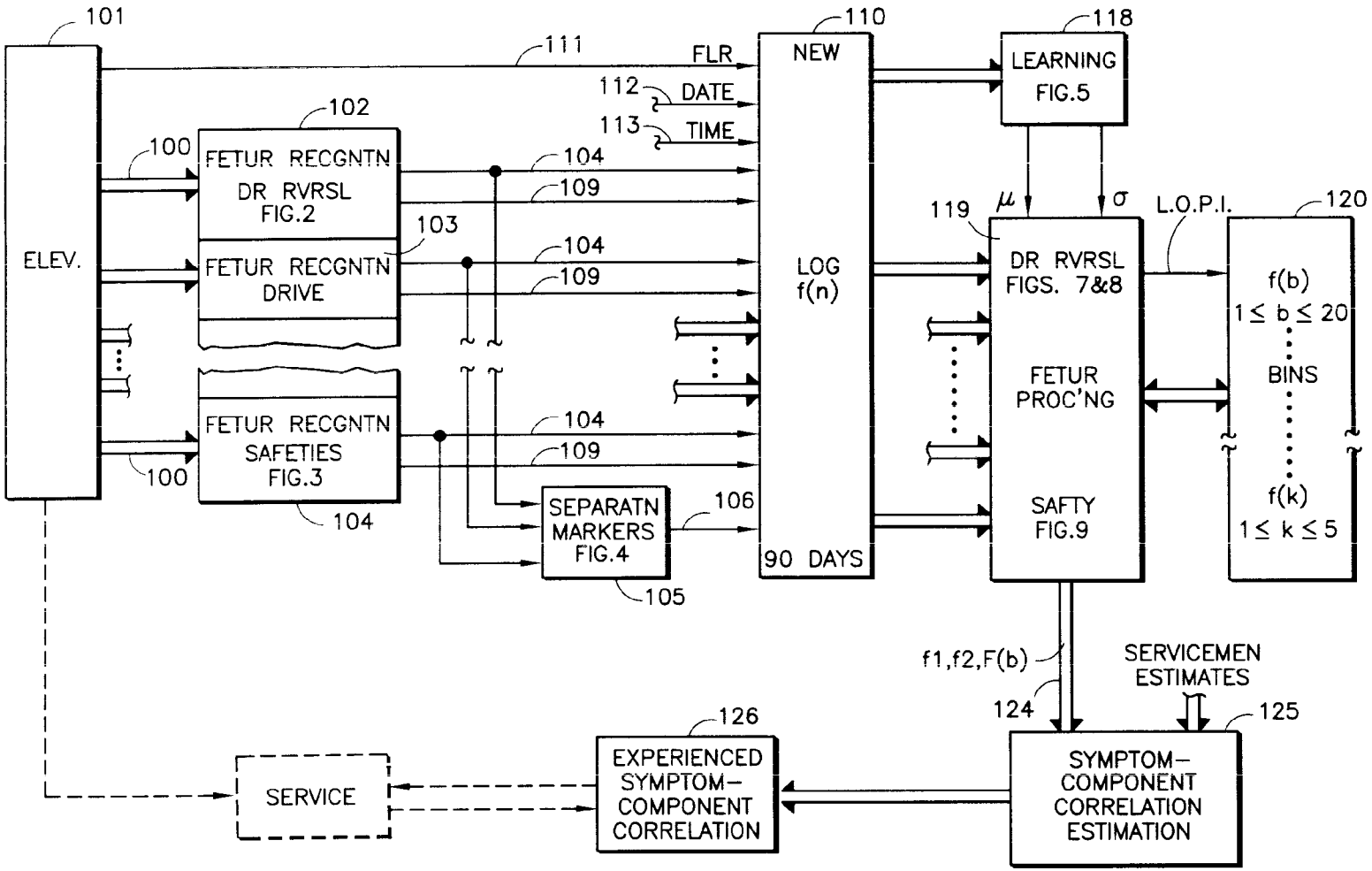
FIG. 1 is a high level, functional block diagram of an exemplary embodiment of the invention.

Referring to FIG. 1, various parameters 100 of an elevator 101 are monitored by various feature recognition routines 102–104, two of which are described with respect to FIGS. 2 and 3 hereinafter, so as to provide corresponding feature signals 104 which are indications of features which are notable with respect to elevator maintenance or servicing, including failures, groups of proximate feature manifestations of related features being separated by markers 105, 106. Attributes 109 of such features, such as duration of the feature or of a related factor, are stored in the log chronologically with each feature. The features and attributes are stored in a chronological log 110 having an address, n, which ranges backwards from the newest features currently being stored (along with their attributes) to features which are 90 days old, the purpose of which is described with respect to FIGS. 6–9 hereinafter. In the chronological log 110, the feature and its duration attribute are stored chronologically with other attributes such as the car direction, the floor number 111, the date 112 and the time 113. One important aspect of the present invention is determining, for door reversals and any other special feature for which passenger interference is likely, the likelihood of passenger interference (L.O.P.I.). If the likelihood of passenger interference is high, then the door reversal (or other feature) may be ignored by service personnel. If the likelihood of passenger interference is medium, then the door reversal may be noted as a possible factor to be investigated during normal maintenance. If the likelihood of passenger interference is low, then the feature may be deemed to be one requiring immediate attention by service personnel. The likelihood of passenger interference is compared against a mean likelihood, $\mu$, and the standard deviation, $\sigma$, which in turn are determined by a learning routine 118 described with respect to FIG. 5. In real time operation after the learning routine is achieved, the likelihood of a door reversal being caused by passenger interference is determined by comparison with $\mu$ and $\sigma$ in feature processing 119, as described with respect to FIGS. 7 and 8 hereinafter. Features of the type in which passenger interference cannot be involved are processed as described with respect to FIG. 9 hereinafter. During feature processing, new databases referred to herein as bins 120 are formed, there being 20 bins having addresses, b, that run from 1 through 20 for door reversals and for any other specific feature in which passenger interference may be involved. On the other hand, feature processing for features not involving passenger interference are stored in strings of five feature spaces addressed herein by c, etc. As described hereinafter, the feature processing deals with only feature spaces, separated by markers, which have the relevant feature (the kind of feature being processed) in such feature space. The feature processing is done real time, such that each time a separation marker 106 is fed into the log 110, processing is based on the first feature within that marker space; that is, the feature that appears immediately chronologically after the next preceding separation marker. However, the processing of each feature utilizes the historical data stored in bins. Once learning has been accommodated as described with respect to FIG. 5 hereinafter, there is no need to maintain the log 110 beyond the current marker, the preceding marker, and the features stored therebetween. Of course, a printout such as is described in Table 1 may be useful, for observation by service personnel. In this embodiment, it is deemed that elevator history which is more than 90 days old will not usually have any relevance to what is occurring at the present time, nor to present servicing.

For each separation marker received by the log, a symptom is generated as a function of the first feature (f1), the second feature (f2), and a floor attribute, F. The first and second features are those that are within the feature space which ended with the last separation marker; the floor attribute is based upon the history of five prior feature spaces that are from the same elevator subsystem (door, drive, etc.) and have the same L.O.P.I.

TABLE 1

| Date | Time | Feature ID | Floor # | Direction | Duration | Flight time |
|---|---|---|---|---|---|---|
| | | Failure making GS | | | 6059.56 | |
| 08/09/98 | 23:14:22.644 | End Marker | 0 | 0 | 6089.22 | |
| | | Door open in flight, ADS | 0 | 0 | 4.64 | 2.93 |
| 08/19/98 | 10:46:30.304 | End Marker | 0 | 0 | 6.89 | |
| | | Failure making DS | | | 2884.96 | |
| 08/26/98 | 23:11:48.845 | End Marker | 11 | 0 | 2936.58 | |
| | | Failure making DS | | | 11.22 | |
| | | Failure making DS | | | 2.79 | |
| | | Failure making DS | | | 1.94 | |
| | | Failure making DS | | | 6223.43 | |
| 09/01/98 | 16:47:40.725 | End Marker | 6 | 0 | 6375.4 | |
| | | Door open in flight, GS | 11 | 0 | 1.42 | 2.65 |
| 09/06/98 | 10:19:49.105 | End Marker | 11 | 0 | 3.25 | |
| | | Door reversal, medium | | | | 0.43 |
| 09/11/98 | 18:42:12.134 | End Marker | 0 | 0 | 4.62 | |
| | | Door reversal, long | | | | 3.34 |
| 09/12/98 | 21:17:07.845 | End Marker | 2 | 0 | 6.53 | |
| | | Door open in flight, GS | 7 | 0 | 1.11 | 0.22 |
| 09/19/98 | 13:24:54.325 | End Marker | 8 | 0 | 3.12 | |
| | | Door open in flight, ADS | 0 | 0 | 49.76 | 1.24 |
| 10/02/98 | 11:47:13.034 | End Marker | 0 | 0 | 56.65 | |
| | | Lost SAF in flight | 2 | 0 | 0.49 | 0.29 |
| 10/02/98 | 11:50:02.815 | End Marker | 9 | 1 | 2.6 | |
| | | ADS rebound | | | | 2 |
| 10/02/98 | 12:01:52.634 | End Marker | 1 | 0 | 0 | |
| | | ADS for too long | | | 169.78 | |
| 10/02/98 | 12:03:43.325 | End Marker | 1 | 0 | 172 | |
| | | Failure making GS | | | 4.48 | |
| 10/12/98 | 21:06:09.235 | End Marker | 3 | 0 | 6.58 | |
| | | Failure making DS | | | 1.28 | |
| 10/28/98 | 15:02:04.544 | End Marker | 0 | 0 | 4.23 | |
| | | ADS rebound | | | | 1 |
| | | ADS open for too long | | | 1250.18 | |
| 11/10/98 | 12:40:52.855 | End Marker | 5 | 0 | 1255.53 | |
| | | Failure making GS | | | 0.34 | |
| 12/04/98 | 18:20:55.384 | End Marker | 0 | 0 | 3.45 | |
| | | Door open in flight, GS | 8 | 0 | 0.14 | 3.87 |
| 12/20/98 | 20:01:35.154 | End Marker | 8 | 0 | 3.85 | |
| | | Failure making DS | | | 1.3 | |
| 12/21/98 | 16:12:46.605 | End Marker | 0 | 0 | 4.12 | |
| | | Door open in flight, GS | 9 | 0 | 1.6 | 1.15 |
| 12/26/98 | 22:01:42.835 | End Marker | 9 | 0 | 3.82 | |
| | | Short reversal | | | | 1.47 |
| | | Medium reversal | | | | 2.8 |
| | | Short reversal | | | | 1.22 |
| | | Short reversal | | | | 1.12 |
| 12/28/98 | 12:22:00.955 | End Marker | 6 | 0 | 42.56 | |

The symptoms 124 are correlated in a symptom component correlation estimation routine 125 during initial operation of the invention. However, once sufficient service information, including the particular component or components which have failed that cause the various symptoms 124 which are determined by the present invention, the symptoms 124 can be correlated accurately 126 to failed components.

An example of a function which the present invention may monitor is door operation, and an example of a related feature is a door reversal. Exemplary routines of the invention for recognizing and recording door reversals and loss of safeties operate continuously, whenever the corresponding elevator apparatus is operating, as one of many routines operating simultaneously as parallel processes. FIG. 2 is an example of an attribute stored with a corresponding feature, in which the duration is of a factor, time since door closure is commanded when the feature, door reversal, occurs. Upon power up, following initialization, the routine will be entered in a start state 11 and will repetitively cycle through a negative result of a test 12 until such time as the elevator door is fully open. Then an affirmative result reaches an open state 13 in which the routine will continuously cycle through a negative result of a door close command test 17, until there is a door close command. Then, a step 18 will start a door reversal timer; if a normal closure occurs, the starting of the door reversal timer will have been unnecessary; but if there is a door reversal, then the important thing to know is how soon the door reversed after the door was commanded to close. As the door is closing, the routine cycles within a closing state 21 in which a test 22 determines if the door closed switch is operated or not. If the switch is operated, this represents a normal closure which causes the routine to revert to the start state 11. This is a case where the event did not result in a feature, so the event is ignored entirely.

If test 22 is negative, then a test 23 determines if a door close command is present or not. If there is a door close command, that means that the door continues to be closing, so an affirmative result causes the routine to remain in the closing state 21. If the door close command ceases—which could be because of someone pressing the door open switch button, or operation of a door safety switch, such as a between-door presence detector, or if there is some sort of failure—in which case, a negative result of test 23 reaches a step 24 to stop the door reversal timer. This setting of the door reversal timer indicates the period of time during which the door motor was powered to close the door. After that, the routine is in a wait state 25 in which it cycles through negative results of a pair of tests 26, 27 until such time as either the door closed switch is operated, such as because a passenger may have forced the door closed to get the elevator to start, or there is a door open command, which the controller would issue after operation of the door open switch or a door safety switch. When the door closing event is ended, either by virtue of the door closed switch operating after loss of the door close command, as indicated in test 26 or by virtue of a true reversal resulting in a door open command, as indicated in test 27, a test 28 determines if the door reversal timer has reached more than 2 seconds. If so, a step 29 will cause a feature identified with the name label "long reversal" to be stored, and then a step 30 causes the door reversal timer to be stored along with it by a step 33, so as to be chronologically related to the feature, as seen in Table 1. If the door reversal timer is set to less than 2 seconds, then a test 31 determines if it is set to less than one second. If so, a step 32 causes a feature to be stored with the name label "short reversal" and the door reversal timer setting is stored with it by a step 30. But if test 31 is negative, then a step 33 causes a feature to be stored with the name label "medium reversal". After the door reversal timer is stored by step 30, the routine of FIG. 1 reverts to the start state 11.

An example of a condition which the invention may monitor and record is the non-door portion of the elevator safety chain ("safeties"). Examples of status indications within the non-door portion of the safety chain, as is known, include the overspeed governor, the final limit switches, and the governor safeties. In FIG. 3, the term "safety" herein refers to all of the safety chain except for the door safeties, because if the door safeties were included in the routine of FIG. 3, every normal elevator stop, when the door switch indicates that the elevator door is not fully closed, would be recorded as a feature. In FIG. 3, with power on and initialization complete, the "loss of safeties" routine begins in a start state 35 which reaches a test 36. When the safety chain is complete, an affirmative result of test 36 causes the routine to reach a safe state 37. In this state, a test 40 determines if the car is running or stopped. If the brake is not released, then the elevator is stopped, and a test 41 determines if the non-door safety chain is complete, or not. If it is, the routine remains in the safe state 37. But when the non-door safety chain is no longer complete, a negative result of test 41 reaches a step 43 to start a safety timer, and a step 44 to store a feature with the name label "safety lost at landing". Then the routine enters a not safe state 45 in which it cycles through a test 46 to determine if the non-door safety chain is fully made, or not; so long as the non-door safety chain is not complete, the routine remains in the not safe state 45. But once the non-door safety chain is again made, an affirmative result of test 46 reaches a step 49 which stops the safety timer and a step 50 which stores the safety timer. The safety timer thus is an example of a duration signal being recorded which is in fact the duration of the feature itself (loss of safeties). The length of time that safeties are lost is an indication of the severity of the problem.

Figure 3:
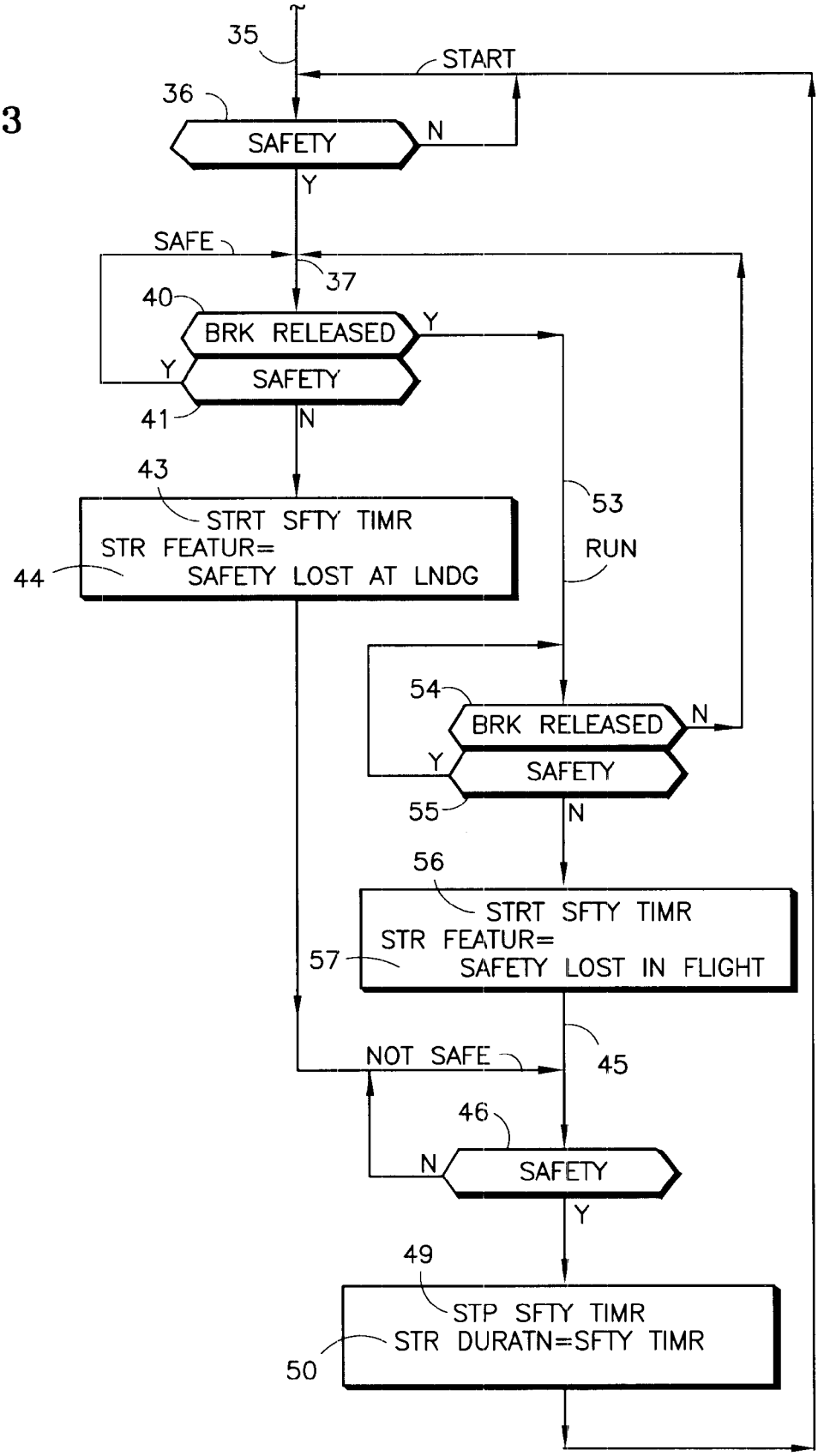
FIG. 3 is a high level logic flow diagram of a non-door safety routine.

If the brake is released (not engaged), the elevator is running, and an affirmative result of test 40 will place the routine of FIG. 3 into a run state 53. In this state, a test 54 determines if the brake is still released, and if it is not, the routine reverts to the safe state; the elevator is always safe when the brake is not released. But if the brake is still released, then a test 55 determines if the non-door safety chain is complete, or not. So long as it is, the elevator is running safely. In the normal case, the run state will cycle through affirmative results of tests 54 and 55 until the elevator car stops at a landing, which results in test 54 being negative to return to the safe state 37. Should there be a failure of the non-door safety chain while the car is running, a negative result of test 55 reaches a step 56 to start the safety timer and a step 57 to store a feature with the name label "safeties lost in flight". Then the not safe state 45 is reached, as described hereinbefore.

Figure 2:
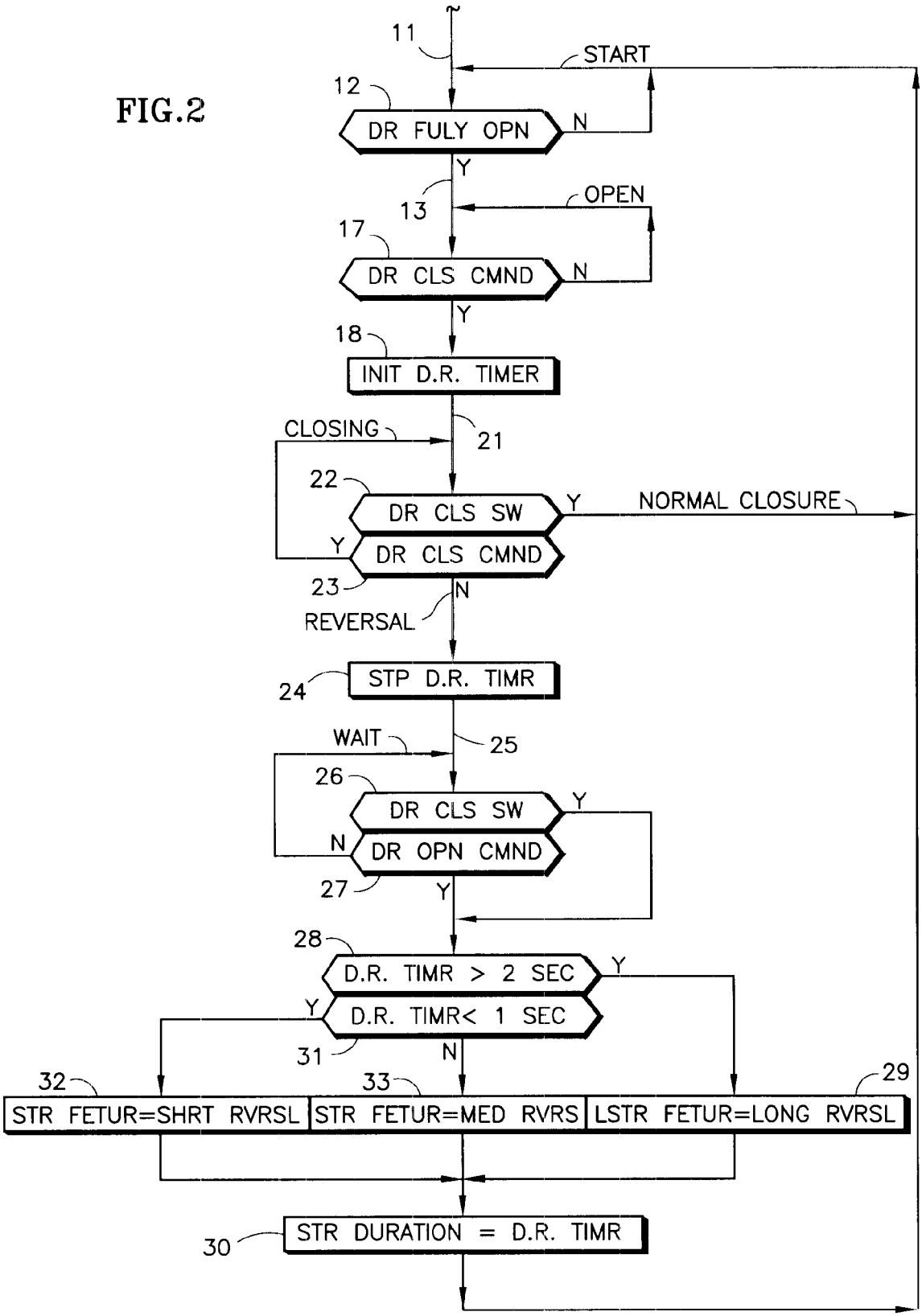
FIG. 2 is a high level logic flow diagram of a door reversal routine.

Feature names and durations represented by timer values, as described with respect to FIGS. 2 and 3, are stored into the chronological log (data base) which includes a primary aspect of the present invention: a separation marker to separate related features into groups. The scheme of separation between related features by means of markers is based on identifying an elevator event, or a time delayed from an elevator event, that indicates the end of a current sequence of notable features which may be related to a common causation (the end of a feature space). For door reversals and loss of non-door safeties, the feature space ends based upon time elapsed following an operational condition of the elevator, the time being shortest when the elevator is running, and slightly longer when the elevator is parked with the door closed, and much longer when the elevator is parked with the door open. If during the related lapse the operating condition changes, then the timer is restarted. Therefore, a series of related features which occur within what is considered to be relevant conditions of operation will be stored together between markers, and those features which occur separated by changes in elevator operating conditions so as to be considered to be casually unrelated will be on opposite sides of a marker (Table 1).

Figure 4:
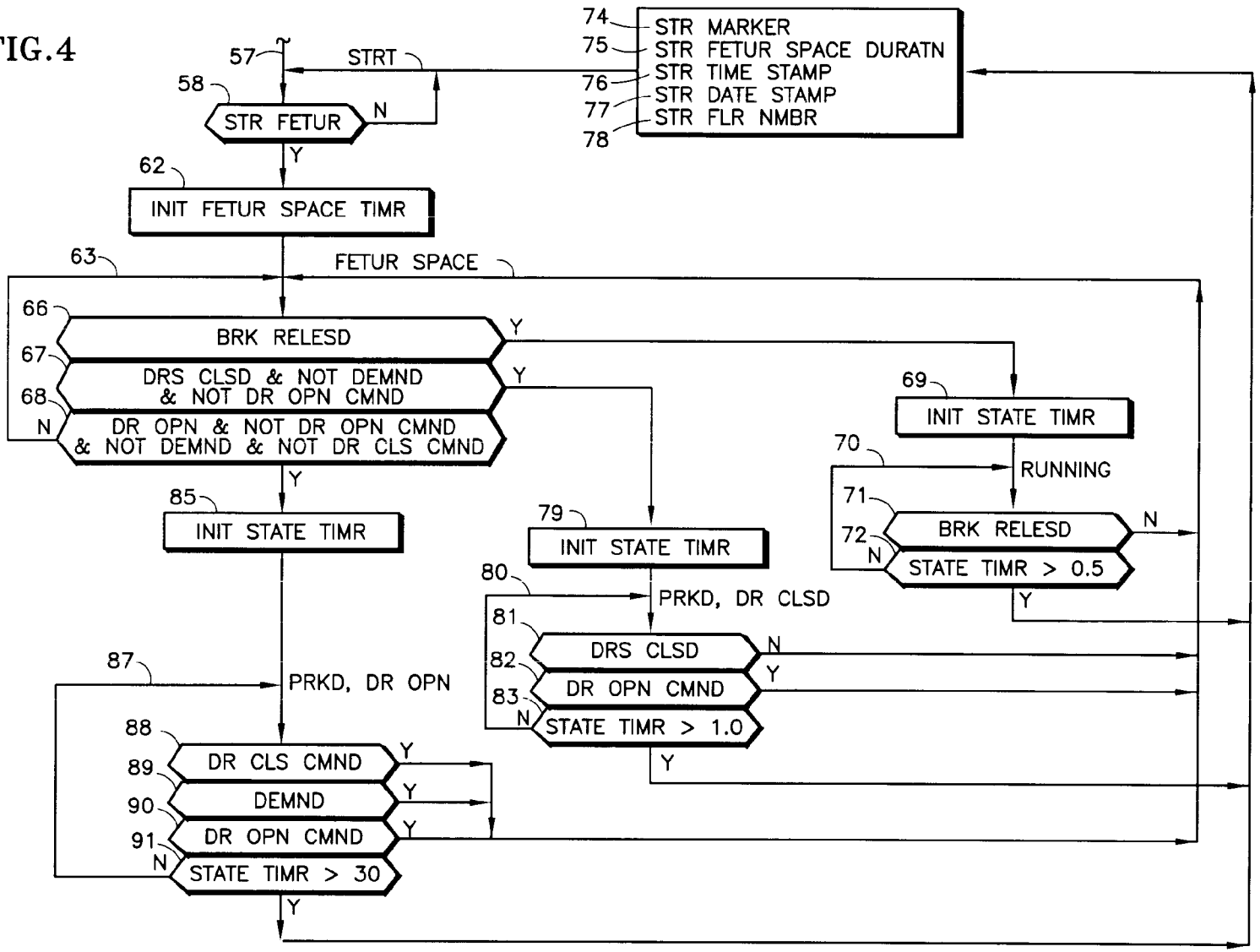
FIG. 4 is a high level logic flow diagram of a separation marker routine.

Following initialization after power is applied, the routine of FIG. 4 will begin in a start state 57, which monitors a test 58 to determine any time when a feature is generated and stored, such as in steps 32, 44, or 57. So long as all the events and conditions in the elevator are not notable, test 58 will be negative, thereby causing the routine to remain in the start state 57. Whenever a feature is stored as described hereinbefore, then test 58 will be affirmative reaching a step 62 to start a feature space timer, which is an attribute that becomes part of the recorded data. The routine of FIG. 4 is then in a "feature space" state 63, wherein the routine may note various conditions and shift between a running state, a parked with door closed state, and a parked with door open state and then, await the passage of the aforementioned times. A series of tests 66, 67, 68 try to determine one of the states: running, parked with door closed, or parked with door open; when the door is in the process of opening or closing, none of those states will exist so the related feature space states 63 will simply cycle through negative results of tests 66, 67 and 68. A test 66 determines if the brake is released, and if it is, a step 69 starts a state timer, reaching a test 71 which again determines if the brake is released. Initially it usually will be, so a test 72 will determine if the state timer has exceeded half of a second, or not. If not, the routine remains in the running state, cycling through an affirmative result of test 71 and a negative result of test 72. If the brake is engaged, the timer is restarted, so it is possible to remain in the running state 70 for more than half a second. But if the brake is not released, the half second will elapse so an affirmative result of test 72 will reach a set of steps 74–78 to store the marker, the feature space duration initiated at step 62, a time stamp, a date stamp and the floor number where the car is stopped. On the other hand, if the brake is engaged before the expiration of one-half second following the last time that it was released, then a negative result of test 71 returns the routine to the feature space state 63. Notice that successive occurrences of loss of safeties can occur within one marker space because the brake will be engaged causing the return to the relates feature grouping state 63, test 66 will be negative, and the presence of demand will cause tests 67 and 68 to be negative. Thus, the feature space will continue until the safeties are restored, the brake is released, and 0.5 seconds elapse. Then, an affirmative result of test 72 will reach a series of steps 74–78 which will store a marker in the log, store the feature space duration, store the time stamp and a date stamp, and store the floor number of the committable floor of the elevator at that time.

If test 66 is negative and test 67 is affirmative, then the routine of FIG. 4 reaches a step 79 to initialize the state timer and then enters a parked, door closed state 80, where it will remain as long as tests 81–83 are negative, meaning that the door closed switch did not open, there is no door open command, and it has not been more than one second since entering the parked, door closed state. If test 81 is negative or test 82 is affirmative, this means the door is no longer fully closed, and the routine will return to the feature space state 63. But if a full second expires after entering this state, an affirmative result of test 83 reaches the steps 74–78 to store a marker, a duration, the time stamps and the floor number, as in Table 1.

If both tests 66 and 67 are negative, but test 68 is affirmative, then a step 85 initiates the state timer and a parked, door open state 87 is reached. Therein, three tests 88–90 determine when the door is no longer open. Whenever there is a door close command or demand, the doors will close, so an affirmative result of tests 88 or 89 will return to the feature space state 63 so as to be able to reach test 67 to switch into the door closed state 80. If there is a door open command, this indicates that there is no steady condition in the elevator, so that more related notable events may occur. Therefore, the routine returns to the feature space state 63. When tests 88–90 are negative, a test 91 determines if 30 seconds has elapsed since entering the parked, door open state. If not, the routine remains in the parked, door open state 87. Eventually, 30 seconds will elapse since entering that state, so an affirmative result of test 91 will reach the steps 74–78 to store a marker, feature space duration, time and date stamps, and floor number, as shown in Table 1.

Referring to FIG. 5, a learning process determines the mean, $\mu$, and standard deviation, $\sigma$, of the number, N, of relevant features per feature space. These are thereafter used in real time to determine the likelihood of passenger interference (L.O.P.I.). The routine for door reversal learning may be entered through an entry point 131. A first step 132 is to identify the feature being processed as "door reversal". Then a step 133 sets an incrementing factor n' equal to a starting value of n, which for the learning process may be the address of the current, newest data in the log, or some other address which is chosen arbitrarily. A step 135 sets a second incrementing value, s, equal to one. A third incrementing value, b', is set equal to zero in a step 136. The routine passes through a step 138, where n' is decremented, and a test 139 until a feature is reached which is not a marker, so that the processing can begin. A marker counter is set to zero in a step 141, and b' is incremented in a step 142. A feature counter is set equal to zero in a step 143. It should be noted that within a single feature space, there may be none, or one, or more of the feature being processed (in this case door reversal) along with one or more features that are not door reversals. The routine of FIG. 5 counts the number of features that are door reversals within each marker space, in the feature counter. The address of the log, n', is decremented in a step 144 and a test 145 determines if the feature stored in the log at n' is the feature being processed (in this case door reversal). If it is door reversal, then a step 148 increments a feature counter; on the other hand, if the feature at the current address is not a door reversal, a negative result of test 145 bypasses the step 148. Two separate counters are required because the feature counter is zeroed for each feature space whereas the marker counter is zeroed for each of the 25 bins. Then a test 150 determines if the current feature is a marker. Initially it will not be, so a negative result of test 150 causes the routine to revert to the step 144 where the address is decremented by one and the test 145 determines if the feature at that address is door reversal (or such other special feature as may be processed in the routine of FIG. 5). The process through steps and tests 144–150 continues until the next marker is found, where an affirmative result of test 150 reaches a test 151 to determine if the feature counter is zero. If it is, that means that this particular marker space had no door reversals in it, and should be ignored; in other words, during the learning process, the routine may move through an address having a separation marker, through several addresses having features, to another address having a separation marker, without encountering any door reversals. In such a case, test 151 will be affirmative causing the routine to revert to step 144 so as to continue the process of scanning features between separation markers. After a feature space is found having the relevant feature (door reversal in this case), when test 150 is again affirmative marking the end of that feature space, the feature counter will no longer be zero so a negative result of test 151 reaches a step 155 which sets the number, N, of features for the bin element b' equal to the value of the feature counter, and a step 156 to increment the marker counter. Then a test 157 determines if a total of 20 markers have been encountered as yet. Initially they will not, so a negative result of test 157 causes the routine to revert to step 142 where b' is incremented and the feature counter is reset to zero by the step 143. The process continues in like manner until twenty feature spaces, each having at least one of the relevant features, have been accumulated, after which an affirmative result of test 157 reaches a step 158 which calculates the average, N', for one set, s, of 20 feature spaces of the number, N, of relevant features (door reversals in this case) in each of the 20 feature spaces, b'. A step 159 determines the range, R, for the first set, s, of 20 feature spaces as the maximum number, N, in any of the 20 bins minus the minimum number, N, in any of the bins. Then a test 160 examines an excess flag (described hereinafter) which during the initial processing is not present. A test 161 determines if a full set of 25 bins have been processed. Initially, they will not, so a step 162*a* will increment 5, and the program will reach the step 141 to zero the marker counter, the step 142 to increment b', the step 143 to zero the feature counter, and again commence processing one address of the log at a time, as described with respect to steps and tests 144–151 hereinbefore. When 25 bins, each having 20 feature spaces, have been processed, an affirmative result of test 161 reaches a step 163 to generate the mean for the feature "door reversal" as 1/25 of the summation of the average number, N', in each of the 25 sets, S. Then a step 164 generates the standard deviation, σ, for the feature "door reversal" as equal to 0.06 times the average range R for all 25 bins, s. The factor 0.06 is found in standard statistical tables.

The routine advances to a step 165 which sets s equal to one and a test 167 determines if the average number of features, N', in bin s is greater than the mean, $\mu$, plus three times the standard deviation, σ. If any such bin is found, an XS flag is set at step 172. A new value, using new data from another point, n', in the log, is calculated in the manner described hereinbefore with respect to steps and tests 136–164, using the same value of s; but this time, test 160 is positive, so test 161 is bypassed and a step 162 resets the XS flag. This will result in a new mean established in step 163 and a new standard deviation established in 164. And then once again all of the bins are checked for excess, using the newly calculated $\mu$ and σ by repeating the step 165 and the test 167. If the current value of the average, N', is now within three standard deviations of the mean, a negative result of test 167 reaches a test 169 to see if s is equal to 25 or not. Initially it will not be, so a negative result of test 168 reaches a step 166 to increment s, thereby to test the next average value of N' in turn. When all of the bins test consecutively with values which are within three standard deviations of the mean, test 168 will be affirmative causing the routine to end at point 169. The values of $\mu$ and σ generated by the routine of FIG. 5 may be utilized indefinitely, but new values may be generated whenever the elevator is significantly altered, either through normal wear or major upgrading.

For any other special feature for which passenger interference may be involved, the routine of FIG. 5 may be entered through a different point, such as a point 170, after which a step 171 will set the feature equal to whatever the special feature is, and the routine will continue, as described hereinbefore with respect to the feature "door reversal".

Figure 6:
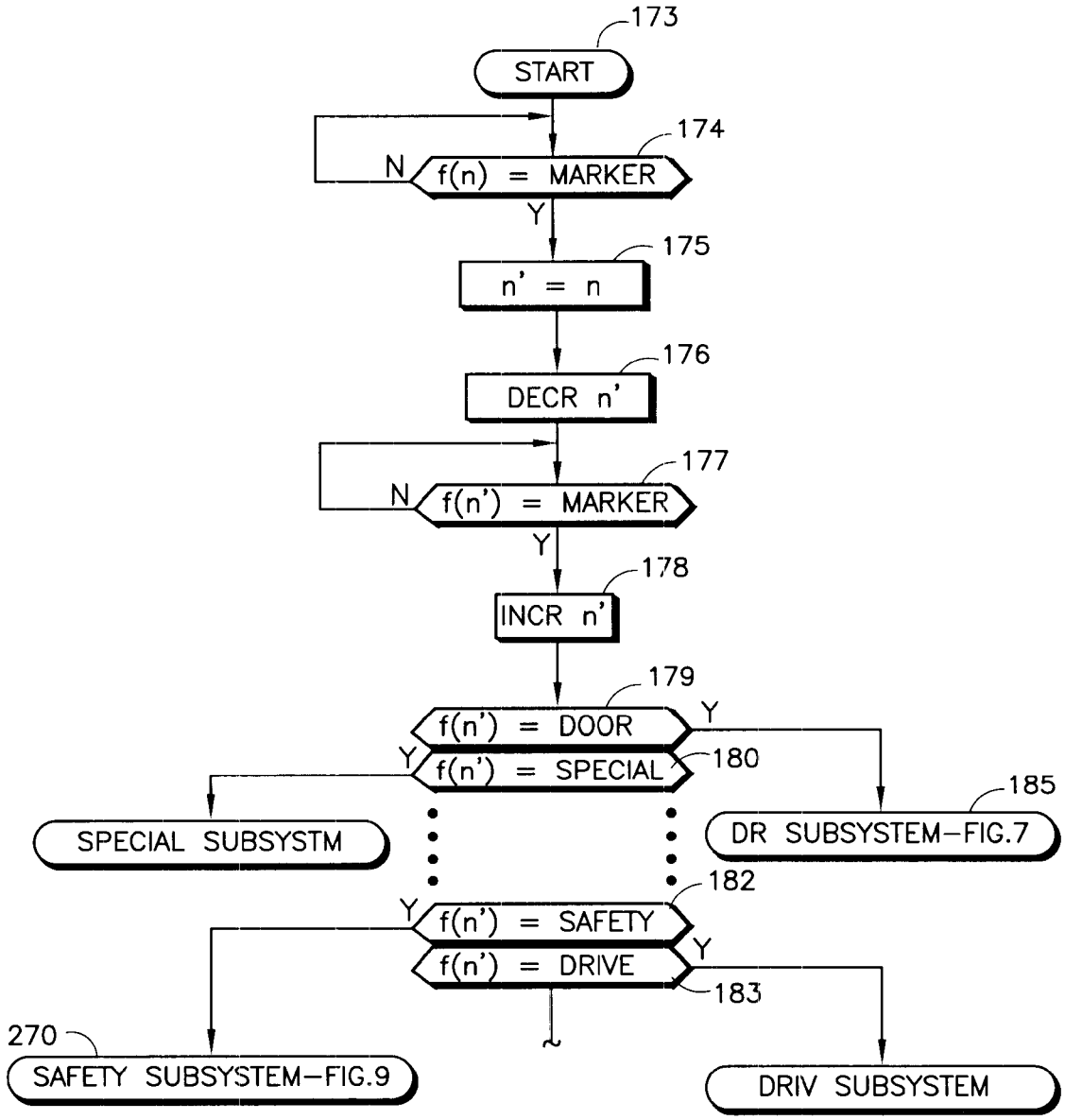
FIG. 6 is a high level logic flow diagram of initialization for feature processing.
Figure 7:
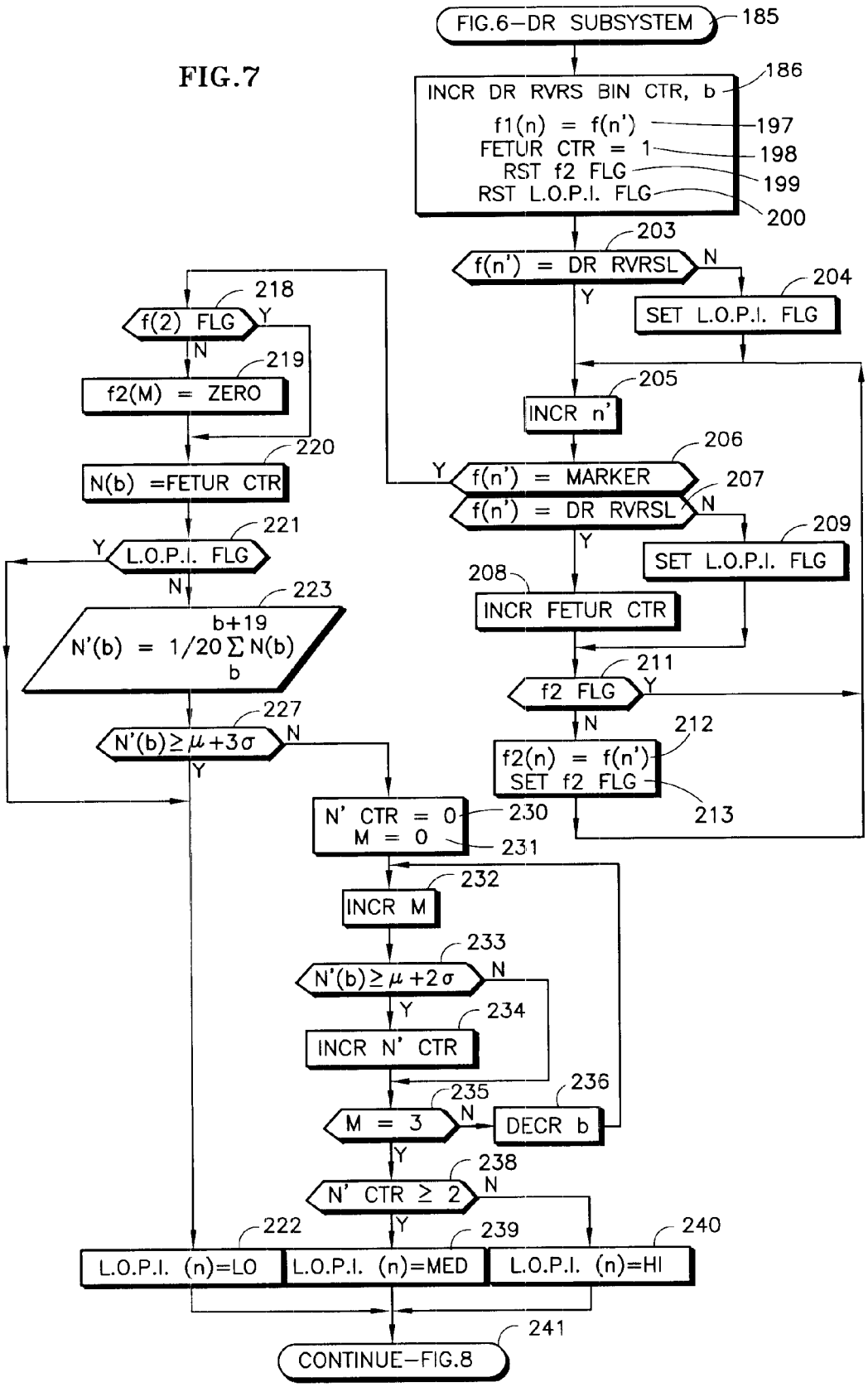
FIGS. 7 and 8 are a high level logic flow diagram of feature processing for the door subsystem.
Figure 8:
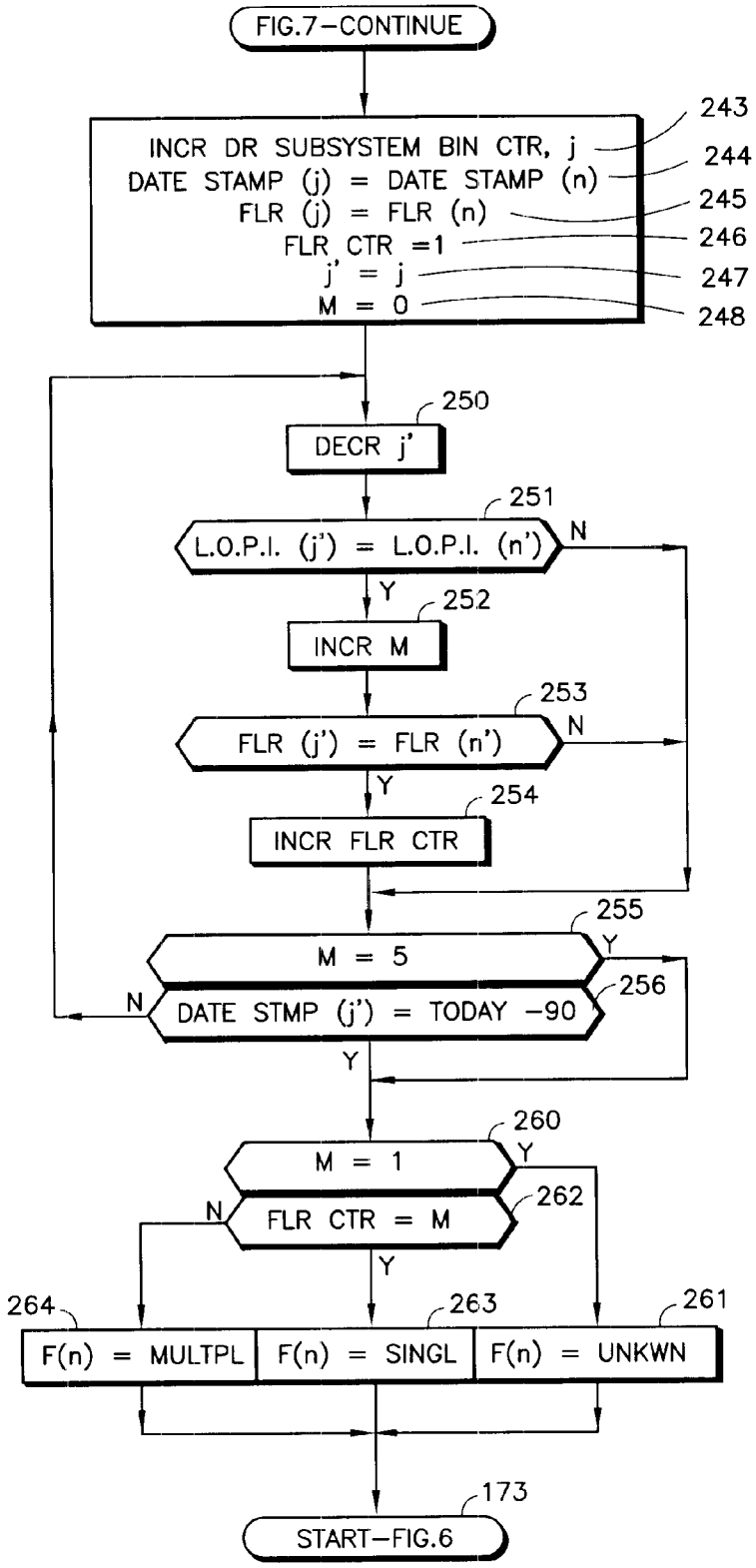

Feature processing for the door reversal feature is illustrated in FIGS. 6–8. After initialization, the routine of FIG. 6 will reach a start state through a transfer point 173. Feature processing relates all of the features stored between a pair of markers; that is, those features that are in the same feature space. As described hereinafter, all of the characteristics of a feature space that are determined by processing are stored at the log address, n, of the marker, M, that identifies the end of the feature space. Whenever the newest entry into the log 110 is a marker, it designates the end of a feature space. An affirmative result of a test 174 will cause the routine to leave the start state and reach a step 175 to set an incrementable number, n', equal to the address, n, of the marker in the log. Then a step 176 decrements n', and a test 177 will determine if a marker is stored in the address n'. Initially it will not (because there are no two markers adjacent), and a negative result of test 177 reaches the step 176 to decrement n' once more. This process will continue until the next preceding marker is located, which designates the beginning of the current feature space. Then a step 178 will increment n', and the processing of the features within the feature space begins. A series of tests 179–183 determine the particular nature of the first feature in the feature space; it characterizes the feature space. Assume that it is a door reversal, so that test 179 will be affirmative reaching the routine of FIG. 7 through a transfer point 185.

In FIG. 7, a step 186 increments a door reversal bin counter, b, modulo 20. The bin counter will simply maintain the number, N, of relevant features (door reversal, in this case) in the 20 most recent feature spaces resulting from processing door reversals. Any feature spaces processed earlier than the 20th oldest feature space are simply discarded. A step 197 sets feature one (f1) for marker M equal to the feature in the log address n'. This is the first feature in the symptom, S(n)=f1(n), f2(n), F(n) previously described for the feature space ending with the marker at address n. The next step 198 sets a feature counter equal to one, a step 199 resets an f2 flag, and a step 200 resets an L.O.P.I. (likelihood of passenger interference) flag, both used in the routine about to be described. First, a test 203 determines if the door subsystem feature at the address of the first feature in the feature space, n', is a door reversal. If it is not, then a step 204 sets an L.O.P.I. flag to indicate that the L.O.P.I. for any features other than door reversal (or other special features in which passenger interference is not involved) automatically have an L.O.P.I. of "low". The address n' is incremented in a step 205 and a test 206 determines if the address n' has a marker stored in it. Generally speaking, it may not, since there may be two or more features in a feature space. In such a case, a negative result of test 206 reaches a test 207 to see if the feature in the second address is a door reversal. If it is, the feature counter is incremented in a step 208. If not, the feature counter is bypassed, and the L.O.P.I. flag is set in a step 209. This accommodates the definition that the L.O.P.I. of any marker space which has any feature other than a door reversal is also designated as "low". Then a test 211 determines if the f2 flag, used only in this routine, has been set. Initially it will not, so a step 212 sets the second feature of the symptom, f2, for this marker equal to the feature that is in the current address of the log. A step 213 sets the f2 flag so that the step 212 will not be repeated for this marker at this time. Then the routine reverts to the step 205 where the address, n', in the log is incremented. The test 206 determines if the current address contains a marker, or not. If not, the test 207 determines if the current address includes a door reversal; if it does, the feature counter is incremented in a step 208, but if it does not, the step 208 is bypassed and the L.O.P.I. flag is set—possibly redundantly. Then the f2 flag is tested. If it had previously been set, the steps 212 and 213 are bypassed. The routine reverts again to incrementing the address in the log at step 205. It should be noted that the feature space may contain one or several door reversals and may have other features interspersed therewith. The process involving the steps and tests 205–213 will be repeated until the log address, n', contains a marker. Then an affirmative result of test 206 reaches a test 218 to see if the f2 flag has been set, or not. If it has not been set, that means that the door reversal being processed was alone in the feature space, so that the second feature in the symptom, f2(n) is set to zero in a step 219. If the f2 flag has been set, the step 219 is bypassed. Then a step 220 sets the number of relevant features (door reversal in this case) for this bin, b, equal to the setting in the feature counter.

It is a feature of the present invention that door reversals, and other special features where passenger interference may be involved, can be categorized by the likelihood of passenger interference (L.O.P.I.) having caused the feature. If a feature space has a feature which is not a door reversal (or other special feature when one is being processed), its L.O.P.I. is automatically identified as being low. A test 221 determines if the L.O.P.I. flag is set, and if so, causes a step 222 to set the L.O.P.I. for this marker, at address n, to "low". Otherwise, a subroutine 223 determines the average number, N', of relevant features (door reversals in this case) per feature space across a bin comprising the 20 most recent, consecutive relevant feature spaces. In this embodiment, each bin (b) stores both the number of features in the feature space which triggered the bin (the feature space currently being processed) as well as the average number of features per feature space, N', across the bin of 20 feature spaces originally related to it. Once the average number, N', is determined in the subroutine 223, the likelihood of passenger interference as being the cause of door reversal in the most recent feature space is determined. First, a test 227 determines if the average number of door reversals per marker space is equal to or greater than the mean, $\mu$, plus three times the standard deviation, $\sigma$ (determined as described with respect to FIG. 5). If it is, then the likelihood of passenger interference is low, which is recorded by the step 222. But if the average does not exceed the mean by three standard deviations, then it is determined whether N' of two out of the three most recent bins is greater than the mean plus two standard deviations. An N' counter is set to zero in a step 230, and a local counting number, m, is set equal to zero in a step 231. The value of b still points to the bin of the feature space being processed (the value of b set in step 186). The value of m is incremented to one in a step 232, and a test 233 determines if the average value, N', of the bin addressed as b, has a value equal to or greater than the mean, $\mu$, plus two standard deviations. If it does, the N' counter is incremented in a step 234, but if it does not, step 234 is bypassed. Then a test 235 determines if the m counter has reached three or not; initially it will not, so a step 236 decrements the address, b and the step 232 increments the m counter. Once again the test 233 determines if the average for the next bin exceeds the mean by two standard deviations. If it does, it is counted at the step 234, and if it does not, it is not counted. Again, test 235 determines if three addresses have been checked or not. When three addresses have been checked, a test 238 determines if the N' counter is equal or greater than two; if it is, this means that two of the last three bins have an average which exceeds the mean by two standard deviations. In that case, a step 239 sets the likelihood of passenger interference, for the feature in the feature space ending with the marker at address n, as medium. But if two of the three do not exceed the mean by two standard deviations, a negative result of test 238 causes a step 240 to set the likelihood of passenger interference as being high. Then the routine continues in FIG. 8, as indicated by the transfer point 241.

In FIG. 8, another door subsystem bin counter, j, is incremented in a step 243; this bin counter keeps track of the floors recorded with the feature space markers for the last five feature spaces of the door subsystem so as to provide data for use as described in FIG. 8. Then, the date stamp for the bin j is set equal to the date stamp of the ending marker at address n in a step 244. And the floor of the bin j is set equal to the floor associated with the ending marker at address n in a step 245. Then, a floor counter is set equal to one in a step 246, an incrementable number, j', is set equal to j in a step 247, and a local counting number, m, is set equal to zero in a step 248. Then a step 250 decrements j so as to refer to the next earlier bin relating to the door subsystem. A test 251 compares the likelihood of passenger interference for the preceding bin with that of the present bin. If they are not the same, then the preceding bin will not participate in determining what the floor factor, F, should be for this feature space. On the other hand, if the likelihood of passenger interference is the same in both bins, then a step 252 will increment m, keeping track of how many bins have the same likelihood of passenger interference and are included in the calculation. Then a test 253 determines if the floor of the preceding bin, j', is the same as the floor of the present bin, j. If it is, the floor counter is incremented in a step 254; if it is not, the step 254 is bypassed. Then a test 255 determines if five suitable bins (having the same elevator subsystem and the same L.O.P.I.) have been examined yet or not. If not, a test 256 determines if the date stamp of this bin, j', is 90 days earlier than today's date stamp. If so, any earlier bins will not be included in the calculation. But if not, a negative result of test 256 causes the routine to revert to the step 250.

This process will continue until either five door subsystem bins have been found having the same likelihood of passenger interference as the present bin, in which case test 255 will be affirmative, or when the last bin examined has a date 90 days earlier than today's, in which case test 256 will be affirmative. Then a test 260 determines if m was only set to one in the step 252. If so, that means that there was only one occurrence of a door system feature, having the same likelihood of passenger interference as the present door system feature space, within the last 90 days. In such a case, the floor factor F, for the feature space ending at the current marker, at address n, is set equal to "unknown" in a step 261. If the floor counter is equal to m, that means that the floor of each successive bin, j', is the same as the floor of this bin, j, each time that m was incremented, causing a corresponding increment in the floor counter. Therefore, all of the door system feature spaces having the same likelihood of passenger interference as the current feature space occurred on the same floor as that of the current door system feature space (that of bin j). Therefore, the floor factor, F, for the feature space ending at the current marker, at address n, is indicated as "single" in a step 263. But if any bin with the same likelihood of passenger interference did not have the same floor as the present bin, then the floor counter will not equal m, so the test 262 will be negative and the floor factor, F, for the feature space ending at the current marker, at address n, will be set equal to "multiple" in a step 264. The floor factors, F, are part of the symptom, S, for the feature space ending at the current marker, at address n, equal to f1(n), f2(n), F(n), used in the manner described hereinafter. Then the program reverts to the start state of FIG. 6 through the transfer point 173.

In the preceding description, the exemplary feature was door reversal. This may either be a situation where short, medium and long door reversals occur, but they are processed in the manner described with respect to FIGS. 6–8 all as one. On the other hand, the foregoing description may be utilized separately for a short door reversal, a medium door reversal or a long door reversal, in dependence upon the particular utilization to which the invention is to be put.

Figure 9:
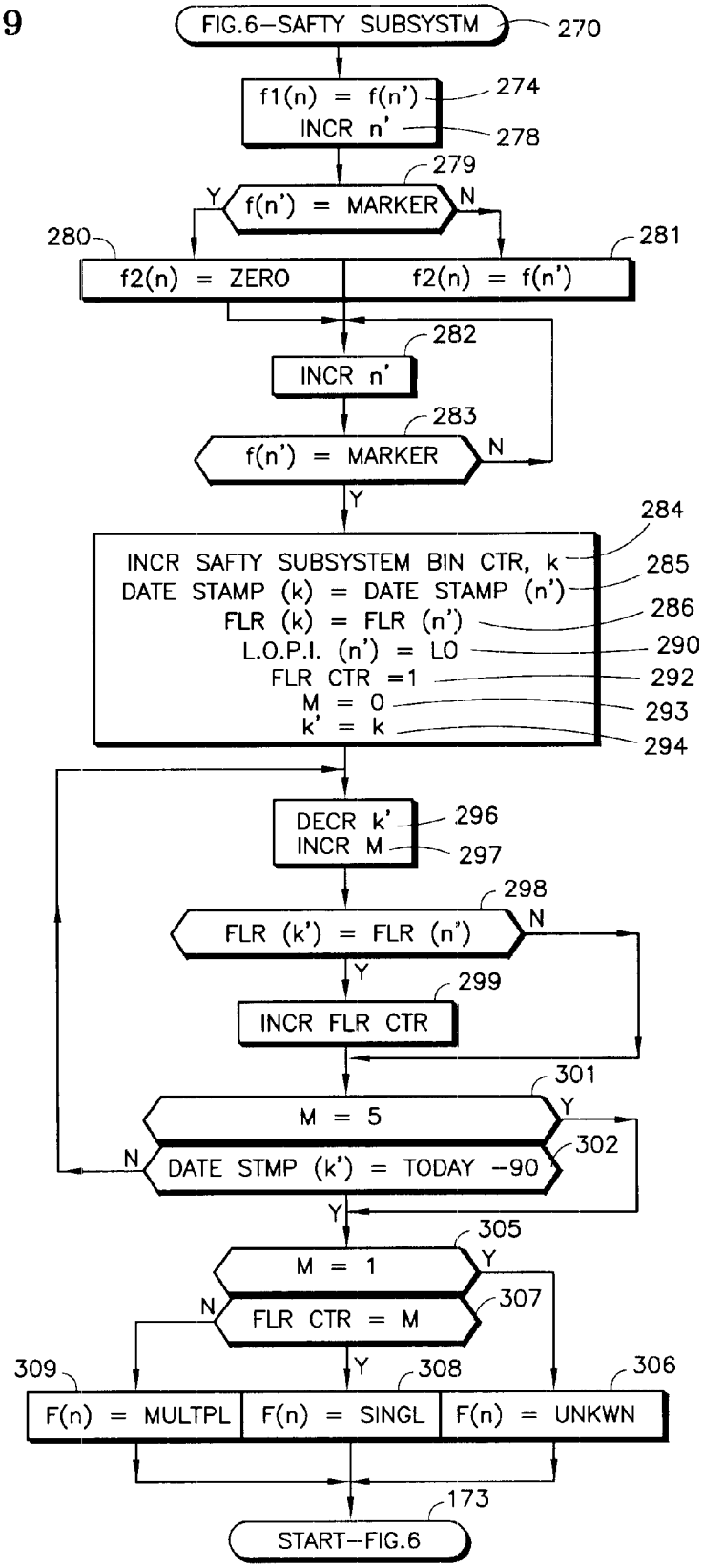
FIG. 9 is a high level logic flow diagram of feature processing for the safety subsystem.

In FIG. 6, at a different point in time, assume that test 179 is negative but test 180 is affirmative. This will lead to feature processing for a special feature in which the likelihood of passenger interference exists. In such a case, the processing will be the same as described hereinbefore with respect to FIGS. 7 and 8, utilizing bins that relate to the special feature. On the other hand, perhaps test 180 is negative, and test 182 is affirmative, reaching a transfer point 270 which will lead to processing of a feature related to the safety subsystem, as illustrated in FIG. 9. Then, a step 274 sets the first feature of the feature space ending at the current marker, at address n, equal to the first feature, f, in the feature space being processed, which is at address n', due to steps and test 177–178 in FIG. 6. Then a step 278 increments n' so as to point to the second feature in the feature space. A test 279 determines if the second feature in the feature space is a marker, or not. If it is, that means that there is only one feature in that space, so an affirmative result of test 279 reaches a step 280 to set the second feature, f2, of the feature space ending at the current marker, at address n, equal to zero. On the other hand, if the second feature is not a marker, then a negative result of test 279 reaches a step 281 to set the second feature, f2, for the feature space ending at the current marker, at address n, equal to the second feature of the feature space, stored at n' in the log.

Then a step 282 and a test 283 will increment n' until it once again addresses the marker at the end of the feature space. A step 284 increments the safety subsystem bin counter, k, which is modulo five; for features not having any likelihood of passenger interference, the single or multiple nature of the floor related to a feature is determined from five most recent bins. Anything beyond the fifth most recent bin is simply discarded and a new bin takes its place. A step 285 sets the date stamp for this bin equal to the date stamp of the address, n', of the ending marker of the feature space being processed. And, the floor of this bin, k, is set equal to the floor of the ending marker of the feature space being processed, at address n', in a step 286. The L.O.P.I. for the feature space, since it is not a door reversal or other special feature, is set to "low" in a step 290, and a floor counter is set equal to one in a step 292. A local number, m, used in the following routine is set equal to one in a step 293 and the incrementable bin counter address, k', is set equal to this bin, k, in a step 294. Then, k' is decremented in a step [297] 296 so as to point to the next prior bin in the sequence of safety subsystem bins, and the number m is incremented in a step 297. A test 298 determines if the floor of the bin being examined is the same as the floor of the ending marker for the feature space under consideration in a test 298, and if it is, the floor counter is incremented in a step 299. But if not, then step 299 is bypassed. A test 301 determines if five bins, including the one relating to the feature space being processed, have been compared. If not, then a test 302 determines if the date stamp on the last bin to be checked is equal to 90 days before today. If not, the program reverts to the step 296 and the process continues until either five bins have been compared to the present bin or the last bin examined has a date 90 days earlier than today's. In such a case, an affirmative result of either test 301 or 302 will reach a test 305 to see if m was only set to one in the step 297. If so, the floor factor, F, for the feature space ending at the current marker, at address n, is set equal to "unknown" in a step 306. If m is not equal to one and the floor counter is equal to m, that means that the floor of each successive bin, k', is the same as the floor of this bin, k; therefore, all the floors were alike and the factor, F, is set as "single" in a step 308. But if the floor counter did not advance as far as the m counter, then two or more floors are involved so a step 309 sets F equal to multiple. Then, the program reverts to the start state of FIG. 6 through the transfer point 173.

After the, present invention is applied to a particular elevator, or a group of nearly identical elevators, for about six to eight months, the probability that the root cause of a particular symptom, S, including f1, f2, and F, is the failure of a specific component of the elevator, can be made from service records which correlate each of the symptoms to the actual components determined to be faulty. This can be expressed as the probability, P, of component C causing symptom S:

$$P(C/S) \qquad \text{EQ. 1}$$

Prior to acquisition of an adequate service history, the probability can be estimated, due to the following relationship:

$$P(C/S) = \frac{P(S/C)\ P(C)}{P(S)} \qquad \text{EQ. 2}$$

where P(S/C) is the probability that a failed component causes a particular symptom, P(C) is the probability of any component, C, failing, and P(S) is the probability of any particular symptom occurring.

From previous failure statistic reports for a given elevator or elevator type, the probability that any particular elevator fault or breakdown resulted from the failure of component C, is P(C).

The factor P(S/C) is not available without history of elevator operation with the invention in place. However, experts in elevator service and repair may estimate the likelihood, P', that failure of each component, C, will cause a particular symptom, S:

P' (S/C)=strong=0.8

P' (S/C)=medial=0.5

P' (S/C)=weak=0.2 or P' (S/C)=none=0.0

Similarly, the factor P(S) is not available prior to acquiring history utilizing the present invention. However, statistically, the summation of the probability that failure of any specific component causes a particular symptom, across all possible components, must equal unity:

$$\sum_c P(C/S) = 1 \qquad \text{EQ. 3}$$

Substituting EQ. 2 into EQ. 3, $$\sum_c \frac{P(S/C)\ P(C)}{P(S)} = 1 \qquad \text{EQ. 4}$$

Substituting the estimated likelihood, P'(S/C), and the unknown normalizing factor, P'(S), into EQ. 4:

$$\sum_c \frac{P(S/C)\ P(C)}{P'(S)} = 1 \qquad \text{EQ. 5}$$

$$\text{or } P'(S) = \sum_c P'(S/C)\ P(C) \qquad \text{EQ. 6}$$

and the estimated probability that symptom S is caused by failure of component C is $$P'(C/S) = \frac{P'(S/C)\,P(C)}{\sum_{c} P'(S/C)\,P(C)} \qquad \text{EQ. 7}$$

Whether estimated probabilities are used (such as during the initial application of the present invention), or actual probabilities are used (determined from operating with the invention for some number of months), the probability of a particular component causing a particular symptom will be associated with each symptom, and therefore with the ending marker for each feature space. It is believed to be preferred that probability of components causing symptoms be provided only for features which have a low likelihood of passenger interference (L.O.P.I.).

The aforementioned patent application is incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of monitoring and processing operating parameters of an elevator having a car, comprising:

(a) determining, from elevator operational parameters, the occurrence of events or conditions which constitute notable features of various types having significance with respect to elevator performance, and in response to each occurrence of any of said notable features, providing a corresponding feature signal, said notable features including specific notable features indicative of elevator operational events which could be caused either by elevator operational conditions or by passenger activity, (b) in response to each said feature signal, storing a corresponding manifestation of said notable feature in a chronological log to provide related stored feature manifestations including stored specific feature manifestations, (c) dividing said stored feature manifestations into groups of proximate feature manifestations which may be related to a common causation;

during a non-operational learning phase (d) determining from said stored specific feature manifestations, the mean of the number of said manifestations in each of a plurality of said proximate groups and storing a corresponding first mean manifestation in response thereto for each of said groups;

(e) determining the range of said numbers in said groups and storing a range manifestation indicative thereof;

(f) providing the standard deviation of said numbers as a function of said range manifestation and storing a standard deviation manifestation indicative thereof;

during a phase of ordinary elevator operation subsequent to said learning phase (g) continuously performing said steps (a)–(c) and determining from said stored feature manifestations the number of said manifestations in each of said proximate groups;

(h) providing, in response to the relationship between each said number determined in said step (g) and said mean and standard deviation manifestations, a manifestation indicative of the likelihood of passenger interference being the cause of said occurrences of notable operational features.

2. A method according to claim 1, wherein, during said non-operational learning phase:

said steps (d) and (e) are repeated a number of times to provide a plurality of said mean number manifestations and a like plurality of said range manifestations; and said steps (d)–(f) comprise:

determining the mean value of said mean number manifestations and storing said mean manifestation indicative thereof; and providing said standard deviation manifestation as a function of the mean value of said plurality of range manifestations.

3. A method according to claim 1 wherein said function is 0.06 times said mean value of said range manifestations.

4. A method according to claim 1 wherein said step (h) comprises:

providing a manifestation indicative of the likelihood of passenger interference being the cause of the occurrence of said notable feature as being low if said number determined in said step (g) deviates from said mean by more than three times said standard deviation.

5. A method according to claim 1 wherein said step (h) comprises:

providing a manifestation indicative of the likelihood of passenger interference being the cause of the occurrence of said notable feature as being medium if two of three most recent ones of said numbers determined in said step (g) deviate from said mean by two times said standard deviation.

6. A method according to claim 1 wherein said step (h) comprises:

providing a manifestation indicative of the likelihood of passenger interference being the cause of the occurrence of said notable feature as being high unless (1) said number determined in said step (g) deviates from said mean by more than three times said standard deviation or (2) two of the three most recent ones of said numbers determined in said step (g) deviate from said mean by more than two times said standard deviation.

7. A method according to claim 1 wherein said notable feature is an elevator door reversal.

8. A method according to claim 1 wherein said step (c) comprises:

(i) determining, from elevator operational parameters, an elevator operational event or condition which signifies the end of an elevator operational sequence within which said notable features may be related to a common causation, and generating a separation marker signal in response thereto; and (j) responsive to said separation marker signal, storing a separation marker manifestation chronologically in said log, said separation marker manifestation separating notable features previously recorded in said log from notable features recorded in said log subsequent to recording said separation marker manifestation therein.

9. A method according to claim 8, wherein said feature signal is generated in response to a car door reversing direction during closure; and said marker signal is generated in response to one of (1) the beginning of an elevator run or (2) the elevator being parked.

10. A method of monitoring and processing operating parameters of an elevator having a car, comprising:

(a) determining, from elevator operational parameters, including events and conditions, the occurrence of events or conditions which constitute notable features of various types having significance with respect to elevator performance, and in response to each occurrence of any of said notable features, providing a corresponding feature signal;

(b) in response to each said feature signal, storing a corresponding manifestation of said notable feature in a chronological log to provide related stored feature manifestations;

(c) in response to each said feature signal, storing a floor number signal indicative of the floor location of the elevator car;

(d) dividing said stored feature manifestations into groups of proximate feature manifestations which may be related to a common causation;

(e) for each one of said groups, determining from a predetermined number of said groups in which the first notable feature of the group is the same type of notable feature as the first notable feature in said one group, whether all of said first notable features occurred with said car (1) at the same floor location, and storing a single floor manifestation indicative thereof, or (2) at more than one floor location, and storing a multiple floor manifestation indicative thereof.

11. A method according to claim 10, further comprising:

for each of said groups, if said predetermined number of groups do not have more than a selected number of said groups in which the first notable feature in the group is the same as the first notable feature in said one group, storing a manifestation indicative of (1) and (2) being unknown.

12. A method according to claim 11 wherein said selected number is one, including said one group.

13. A method of monitoring and processing operating parameters of an elevator having a car, comprising:

(a) determining, from elevator operational parameters, including events and conditions, the occurrence of events or conditions which constitute notable features of various types having significance with respect to elevator performance, and in response to each occurrence of any of said notable features, providing a corresponding feature signal;

(b) in response to each said feature signal, storing a corresponding manifestation of said notable feature in a chronological log to provide related stored feature manifestations;

(c) dividing said stored feature manifestations into groups of proximate feature manifestations which may be related to a common causation;

(d) for each one of said groups, providing a signal manifestation of a symptom, S, including at least the first feature in said group and the second feature, if any, in said group;

(e) providing an estimated probability, P', that symptom S is caused by failure of each such component, C:

$$P'(C/S) = \frac{P'(S/C)\ P(C)}{\sum_c P'(S/C)\ P(C)}.$$

14. A method according to claim 13, further comprising:

for any one symptom, S, generated in said step (d), providing a manifestation of a list of possible components, the failure of which may have caused said one symptom, said list being in the order of most likely first and least likely last as determined by said step (f).

15. A method of monitoring and processing operating parameters of an elevator having a car, comprising:

(a) determining, from elevator operational parameters, occurrence of events or conditions which constitute notable features of various types having significance with respect to elevator performance, and in response to each occurrence of any of said notable features, providing a corresponding feature signal, said notable features including specific notable features indicative of elevator operational events which could be caused either by elevator operational conditions or by passenger activity, (b) in response to each said feature signal, storing a corresponding manifestation of said notable feature in a chronological log to provide related stored feature manifestations including stored specific feature manifestations, (c) dividing said stored feature manifestations into groups of proximate feature manifestations which may be related to a common causation;

during a non-operational learning phase (d) determining from said stored specific feature manifestations, the mean of the number of said specific feature manifestations in each of a plurality of said groups and storing a corresponding first mean manifestation in response thereto for each of said groups;

(e) determining the range of said numbers in each of said groups and storing a range manifestation indicative thereof;

(f) providing the standard deviation of said numbers as a function of said range manifestation and storing a standard deviation manifestation indicative thereof;

(g) for each component, C, of the elevator which has a failure history, (1) having experts estimate the probability P'(S/C) of the failure of such component to result in any one or more symptom, S, and (2) determining the likelihood P'(C) of any component failure being a failure of such component;

during a phase of ordinary elevator operation subsequent to said learning phase (h) continuously performing said steps (a)–(c) and determining from said stored specific feature manifestations the number of said manifestations in each of said proximate groups;

(i) providing, in response to the relationship between each said number determined in said step (h) and said mean and standard deviation manifestations, a manifestation indicative of the likelihood of passenger interference being the cause of said occurrences of notable operational features;

(j) in response to each of said feature signals, storing a floor number signal indicative of the floor location of the elevator car;

(k) for each one of said groups, determining, from a predetermined number of said groups in which the first notable feature of the group that is the same type of notable feature as the first notable feature in said one group, whether all of said first notable features occurred with said car (1) at the same floor location, and storing a single floor manifestation indicative thereof, or (2) at more than one floor location, and storing a multiple floor manifestation indicative thereof;

(l) for each one of said groups, providing a signal manifestation of a symptom, S, including at least the first feature in said group and the second feature, if any, in said group; and (m) providing an estimated probability, P, that symptom S is caused by failure of each such component, C:

$$P'(C/S) = \frac{P'(S/C)\ P(C)}{\sum_c P'(S/C)\ P(C)}.$$

* * * * *